United States Patent [19]

Volat

[11] Patent Number: 4,940,219

[45] Date of Patent: Jul. 10, 1990

[54] APPARATUS FOR FORMING A STACK OF FLAT OBJECTS SUCH AS LETTERS

[75] Inventor: Jean-Pierre Volat, Aix-En-Provence, France

[73] Assignee: Bertin & Cie, Plaisir, France

[21] Appl. No.: 325,229

[22] Filed: Mar. 17, 1989

[30] Foreign Application Priority Data

Mar. 18, 1988 [FR] France ..... 88 03592

[51] Int. Cl.[5] ..... B65H 31/00

[52] U.S. Cl. ..... 271/2; 271/3.1; 271/180; 271/181; 271/188; 271/197; 271/200; 271/201; 271/213; 271/214; 271/314; 271/184

[58] Field of Search ..... 271/2, 3.1, 200, 201, 271/209, 213, 214, 215, 217, 296, 300, 302, 306, 180, 181, 184, 188, 189, 198

[56] References Cited

U.S. PATENT DOCUMENTS

| | | | |
|---|---|---|---|
| 3,051,333 | 8/1962 | Richert et al. | 271/201 X |
| 3,152,701 | 1/1961 | Weiland | 271/215 |
| 3,160,413 | 12/1964 | Faeber | 271/188 |
| 3,473,800 | 10/1969 | Nystrand | 271/184 X |
| 3,682,473 | 8/1972 | Kuyt | 271/3.1 X |
| 3,690,474 | 9/1972 | Klappeneker | 271/201 X |
| 3,729,191 | 4/1973 | Yoshimura et al. | |
| 3,918,704 | 11/1975 | Sugiyama et al. | 271/201 |
| 4,019,730 | 4/1977 | Staudinger et al. | 271/214 X |
| 4,299,379 | 11/1981 | Preston et al. | 271/3.1 |
| 4,509,739 | 4/1985 | Kurokawa | 271/215 X |
| 4,547,113 | 10/1985 | Welch et al. | 271/217 X |
| 4,655,131 | 4/1987 | Kramer | 271/2 X |
| 4,717,144 | 1/1988 | Rosengren | 271/181 X |
| 4,799,663 | 1/1989 | Golicz | 271/213 |
| 4,802,664 | 2/1989 | Larsen | 271/201 |

FOREIGN PATENT DOCUMENTS

| | | |
|---|---|---|
| 2419630 | 11/1974 | Fed. Rep. of Germany . |
| 3237815 | 5/1983 | Fed. Rep. of Germany . |

OTHER PUBLICATIONS

Holovka, Jr., "Card Pusher", 10-1972, IBM Technical Disclosure Bulletin, vol. 15, No. 5, pp. 1416-1417.

*Primary Examiner*—Joseph J. Rolla
*Assistant Examiner*—Boris Milef
*Attorney, Agent, or Firm*—Bell, Seltzer, Park & Gibson

[57] ABSTRACT

An apparatus for forming a stack of flat objects such as letters on a support is disclosed. A conveyor moves flat objects to the support. A stacking apparatus moves the flat objects onto the support into abutment against a jogging wall of the support. The conveyor and stacking apparatus are supported on a table which is movable relative to the support and stack. The stacking apparatus extends between the conveyor and jogging wall and includes an end having an axis about which the stacking apparatus is pivoted so as to be displaceable towards and away from the end of the stack.

11 Claims, 4 Drawing Sheets

APPARATUS FOR FORMING A STACK OF FLAT OBJECTS SUCH AS LETTERS

The invention relates to apparatus for forming a stack of flat objects such as letters, postal packets, or the like, for example, on a support in the form of a trough between two perpendicular walls with each flat object bearing against said walls via a leading edge and a side edge.

BACKGROUND OF THE INVENTION

Such apparatus may be used, in particular, in postal sorting installations, e.g. for forming a buffer stock of letters between two sorting machines.

The letters leaving a machine of this type are generally stored in trays which are transported to the following machine. A stack of letters is placed by hand on a support in the form of a right angle trough and having an unstacking device at one end thereof for taking the letters one by one from the stack and placing them at the inlet to conveyor means feeding some other machine. While being conveyed, letters are generally pinched between two endless belts or bands which are guided over rolls along the path to be followed, with the letters being placed between the belts either in an overlapping or roofing tile configuration (with the leading edge of each letter overlapping the trailing edge of the preceding letter), or else the letters are separate from one another.

German patent application 3 237 815 describes apparatus for forming a stack of letters on a trough-shaped support, said apparatus comprising conveyor means for conveying letters to the immediate vicinity of the support, stacking means for stacking the letters on the support, and displacement means for obtaining relative displacement of the conveyor means and the stacking means relative to the support or relative to the stack of letters formed on the support. In this prior apparatus, the stacking means for stacking the letters on the support are pivotally mounted on the end of the letter conveyor means, in such a manner as to be capable of moving away from the stack of letters and causing it to advance, e.g. on arrival of a relatively thick letter.

By virtue, of the stacking means being pivotally mounted on the end of the conveyor means, this prior apparatus is poor at accepting letters which are particularly stiff or particularly thick. This operating defect is further accentuated by the fact that the letter stacking means are oriented at a slight angle relative to the stack of letters and cause the top letters of the stack to be folded.

Finally, the pivoting assembly including the letter stacking means has considerable inertia, thereby preventing a high throughput of letters being conveyed to and stacked on the support.

The object of the invention is to provide apparatus of the same type but avoiding the above-mentioned drawbacks and defects.

More generally, the object of the invention is to provide apparatus for forming a stack of flat objects starting from means which convey these objects one after another in an overlapping configuration or separate from one another, and enabling a stack of variable length to be formed with flat objects being added to or taken from the stack independently, either simultaneously or otherwise.

Another object of the invention is to provide apparatus of this type which is capable of operating at very high throughput.

SUMMARY OF THE INVENTION

The invention thus provides an apparatus for forming a stack of flat objects such as letters on a support in the form of a trough having two mutually perpendicular walls with each flat object bearing thereagainst via its leading edge and via one of its side edges, said apparatus including conveyor means for bringing flat objects one after another to the support at a predetermined orientation, close to the orientation the flat objects are to occupy in the stack; stacking means for stacking the flat objects on the support by sliding each flat object over the preceding flat object on the stack and moving it into abutment against a jogging wall of the support; and relative displacement means for obtaining displacement of the conveyor means and the stacking means relative to the stack and the support, the stacking means being loosely mounted relative to the stack, wherein the stacking means are mounted so as to be displaceable towards and away from the end of the stack by pivoting about an axis close to the jogging wall of the support, and are associated with return means urging them constantly towards the stack.

In this way, the inertia of the stacking means is reduced, thereby improving response time and increasing the rate at which flat objects can be conveyed and stacked. Further, when a flat object arrives which is stiff or relatively large, the stacking means move away from the stack of letters at the end of the conveyor means, thereby making it easier for it to accept thick objects and also objects which are particularly stiff.

In one embodiment of the invention, the stacking means comprise an endless band or belt passing over two pulleys one of which is driven by drive means and the other of which is displaceable by pivoting about the axis of the first-mentioned pulley.

In this case, it is the belt pressed against a flat object conveyed by the conveyor means which drives the object by sliding the object over the end of the stack while simultaneously moving itself away from said end of the stack through a distance corresponding to the thickness of the flat object.

Advantageously, the portion of the belt in contact with the end of the stack is parallel to the flat objects in the stack.

This prevents folding and possible damage of the flat objects conveyed to the end of the stack.

Provision is also made for the drive means for rotating the pulley to be controlled by means for detecting the arrival of a letter, in association with timing means for automatically starting and stopping said drive means.

This prevents possible damage to the last conveyed flat object when there is a certain lapse of time before the next flat object arrives.

In a variant, the stacking means include a drive shaft carrying a first cylindrical sleeve mounted to rotate inside a second cylindrical sleeve and in contact therewith, with the coefficient of friction between the first sleeve and the second sleeve being very much less than the coefficient of friction between the second sleeve and any one of the above-mentioned flat objects.

By virtue of this disposition, the drive means for driving the flat objects in the stacking means are stopped automatically as soon as a flat object is brought into abutment against the jogging wall of the support on which the stack of flat objects is being formed.

BRIEF DESCRIPTION OF THE DRAWINGS

Embodiments of the invention are described by way of example with reference to the accompanying drawings, in which.

DETAILED DESCRIPTION

Figure 1:
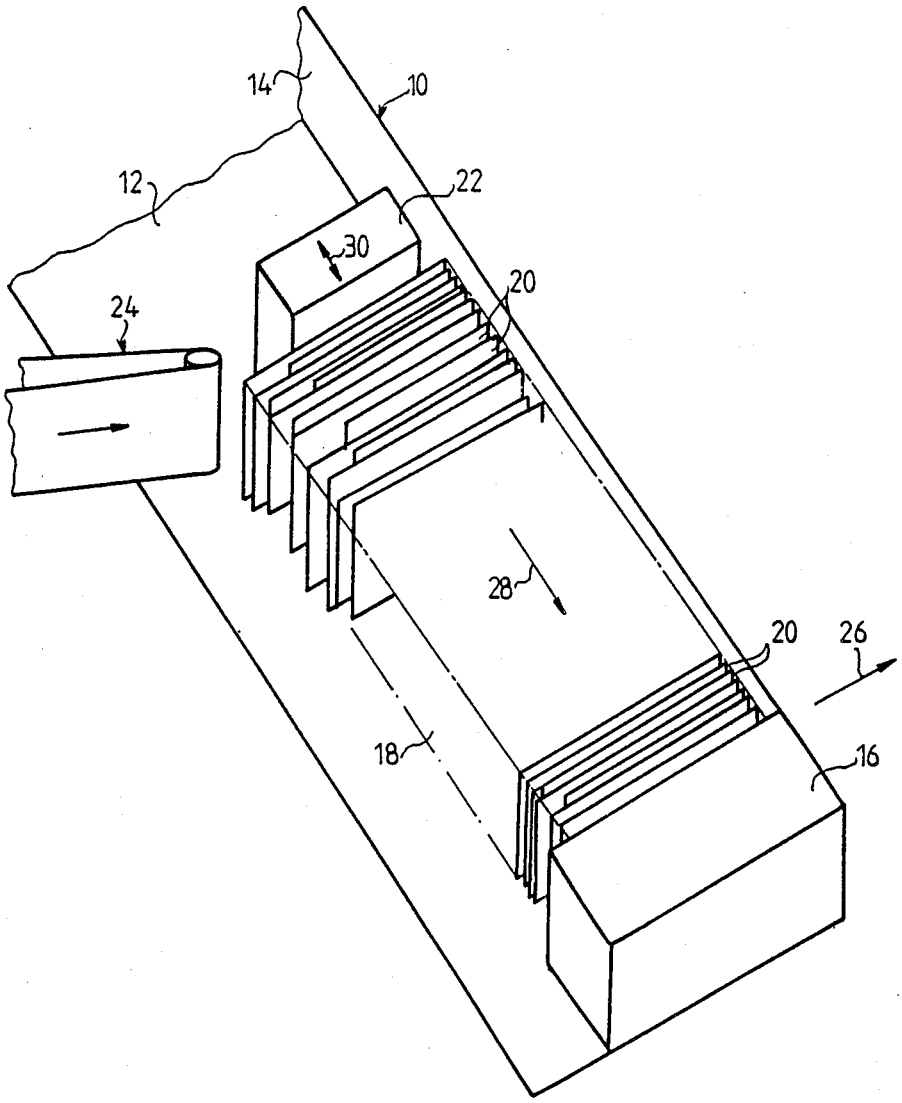
FIG. 1 is a diagram showing how a stack of flat objects is made on a trough-shaped support having two perpendicular walls.

Reference is made initially to FIG. 1 for explaining the principle whereby a variable length stack of flat objects is built up on a support 10 which is in the form of a trough having two perpendicular walls 12 and 14. In order to simplify the description, it is assumed that the walls 12 and 14 of the support are respectively horizontal and vertical, however the support may be inclined in one direction or another.

Unstacking means 16 are disposed at one end of the support for the purpose of unstacking flat objects, with one face of the unstacking means 16 being perpendicular to the two walls of the support, and with a stack 18 of flat objects 20 being built up from said face, with said flat objects being referred to below as "letters". The stacking means 22 is at the opposite end of the stack 18 to the unstacking means 16, and they are associated with conveyor means 24 for conveying the letters 20. The means 24 thus conveys these letters one by one to the stacking means 22, where the letters are stored one after the other on the support 10 in order to build up the stack 18. More precisely, the letters 20 placed on the support 10 bear against the horizontal wall 12 thereof via their bottom edges and they are caused to bear against the vertical or jogging wall 14 thereof via their leading vertical edges. At the other end of the stack, the unstacking means 16 remove the letters 20 one by one in order to displace them in the direction indicated by arrow 26 and apply them to the inlet of further conveyor means (not shown).

Figure 2:
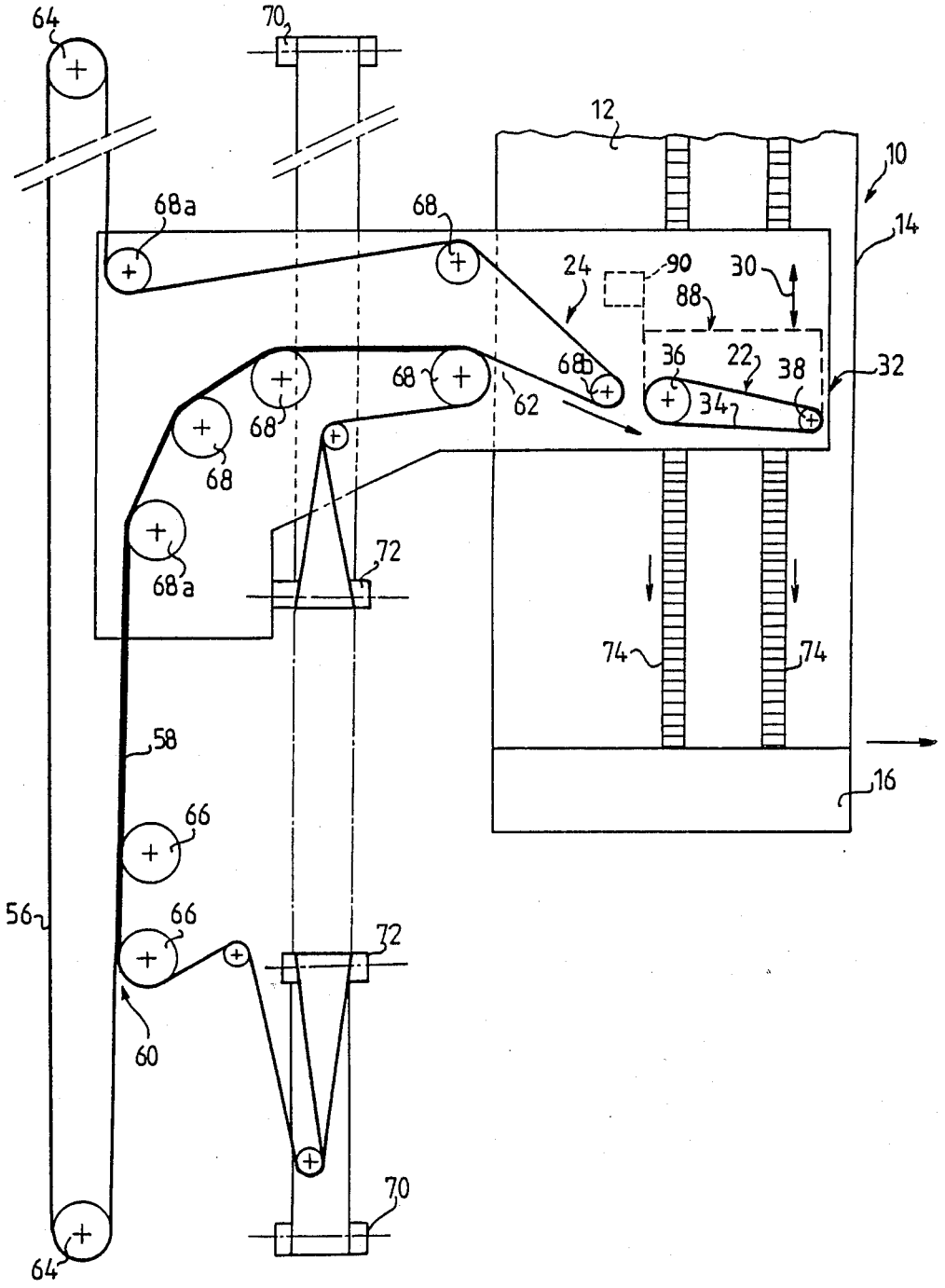
FIG. 2 is a diagrammatic plan view of apparatus in accordance with the invention.
Figure 3:
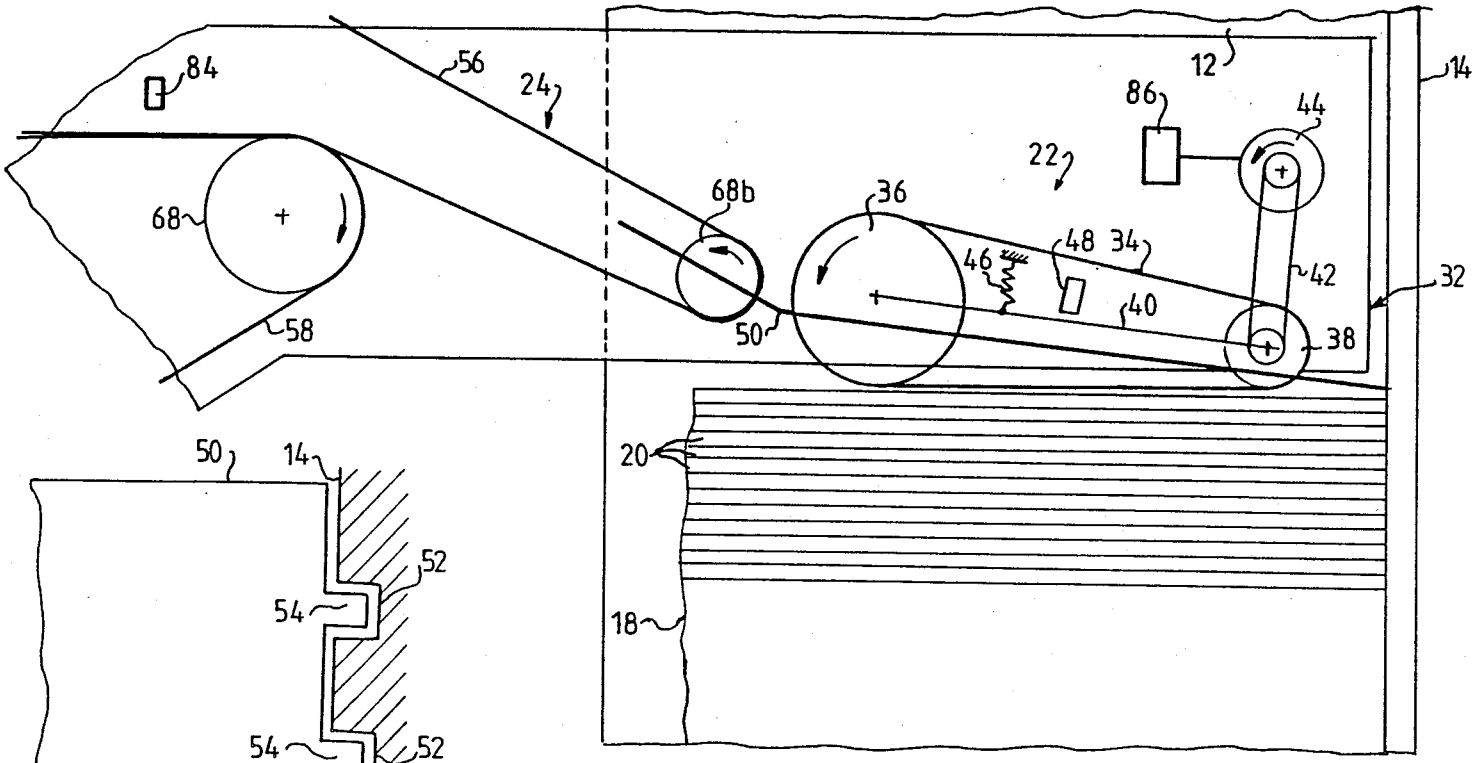
FIG. 3 is a fragmentary view on a larger scale of a portion of said apparatus.
Figure 4:
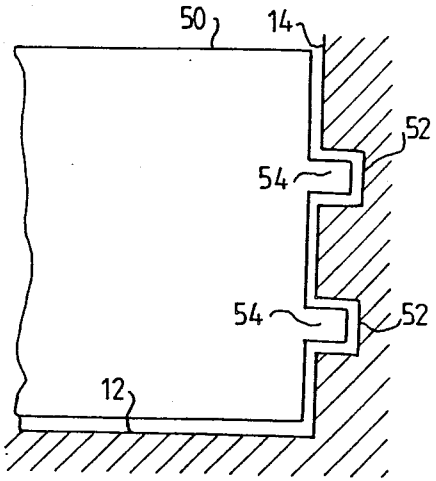
FIG. 4 is a fragmentary section view through the support showing a guide plate for guiding the flat objects.
Figure 5:
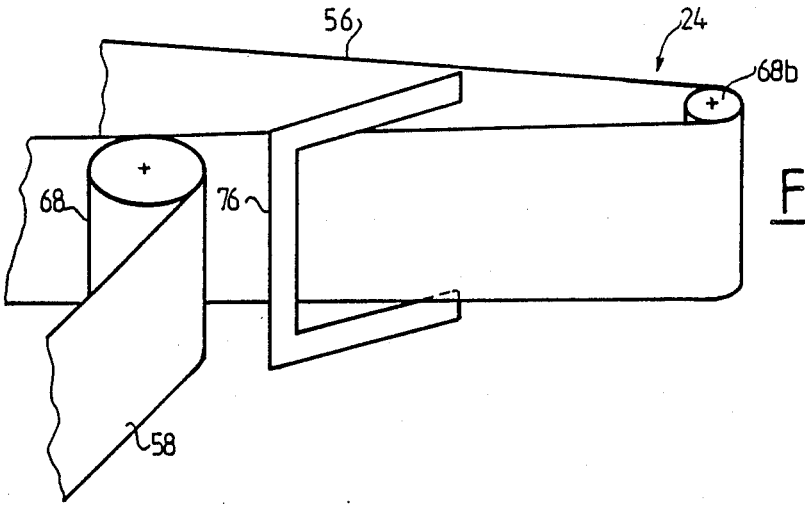
FIG. 5 is an isometric, highly schematic view showing the output end of the conveyor belts.
Figure 6:
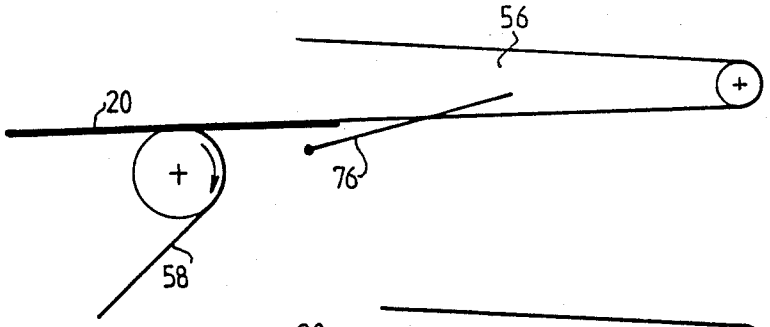
FIG. 6 is a highly schematic, plan view showing a flat object such as a letter fed between conveyor belts.

In conventional manner, the support 10 may include means for moving the stack 18 towards the unstacking means 16, as indicated by arrow 28. The stacking means 22 together with a portion of the conveyor means 24 are moveable in translation parallel to the stack-forming direction, as indicated by double-headed arrow 30, with the position of said means being servo-controlled to the position of the last letter in the stack and thus being capable of varying as a function of the thickness of each letter, as a function of the speed with which the stack moves towards the unstacking means 16, and as a function of the rate at which said unstacking means operate, including periods when said means are in operation and periods when they are stopped. Reference is now made to FIGS. 2 to 4 which show apparatus in accordance with the invention in detail.

These figures show the same support 10, unstacking means 16, stacking means 22, and associated conveyor means 24. The stacking means 22 and a portion of the conveyor means 24 are carried on a common table or plate 32 which is displaceable in the direction indicated by double-headed arrow 30, being guided on columns by means of ball-bearing sleeves, for example, and being displaced in one direction or the other by reversible drive means, é.g. electric motors. In this embodiment, the stacking means 22 comprise an endless band or belt 34 passing over two pulleys 36 and 38 mounted on the table 32 in such a manner that the length of the belt 34 which extends between the pulleys on the letter stack side thereof extends substantially perpendicularly to the direction in which the stack of letters is built up. The two pulleys 36 and 38 are separated from each other by a distance which is no longer than the length of the shortest letter to be placed on the stack. The pulley 36 (FIG. 3) is carried by an arm 40 which is pivotally mounted about the vertical axis of the pulley 38 which is itself situated in the vicinity of the jogging wall 14 and which constitutes the drive pulley by virtue of a belt 42 passing over a drive shaft 44, e.g. the outlet shaft of an electric motor.

The pivot arm 40 is associated with a position detector 48 and with a return spring 46 which constantly biases it towards the end of the stack of letters.

The moving plate or table 32 also carries a guide plate 50 which is disposed vertically and which extends from the outlet of the conveyor means 34 as far as the jogging wall 14. As shown in FIG. 4, the jogging wall 14 includes parallel grooves 52 which run parallel to the building direction of the stack 18 of letters, said grooves receiving ribs 54 on the corresponding vertical edge of the guide plate 50. This disposition ensures that the leading edge of a letter 20 pressed against the jogging wall is not folded therealong, i.e. between the table 32 and the wall 14.

The conveyor means 24 are constituted by endless belt or band conveyors. More precisely, as shown in FIG. 2, the conveyor means comprise a first belt 56 guided over pulleys or rolls, and a second belt 58 also guided over pulleys or rolls, with the two belts 56 and 58 being parallel to each other and being pressed against each other over a portion of their lengths, thereby defining the path followed by letters between the inlet 60 of the conveyor means and the outlet 62 thereof.

The belt 56 passes over two pulleys 64 carried by a fixed frame and separated from each other by a distance which is greater than the length of the stack of letters to be formed on the support 10. Other pulleys 66 also mounted on the fixed frame serve to define the beginning of the common path of the belts 56 and 58.

The other pulleys 68 over which the first belt 56 passes are mounted on the moving table 32, with two of these pulleys designated by reference 68*a* constituting the inlet and outlet pulleys of the belt 56 on the table 32 and being disposed in such a manner that displacements of the table 32 in the direction of double-headed arrow 30 give rise to no change in the length and the tension of the belt 56. The two pulleys 68*a* are preferably in alignment with each other parallel to the direction of double-headed arrow 30, as are the end pulleys 64 mounted on the fixed frame.

The same rule applies to the second belt 58 which also passes over end pulleys 70 which are spaced apart by a distance which is substantially equal to the distance between the pulleys 64. For space-saving reasons, this loop of the belt 58 is disposed in a vertical plane beneath the table 32 with the belt 58 passing for this purpose over horizontal axis deflector pulleys 72, one of which is mounted on the table 32 and the other on the fixed frame.

At the end of the common path of the two belts, i.e. at the outlet from the conveyor means 24, the belt 56 passes over a pulley 68*b* which is relatively close to the first pulley 56 of the stacking means 22, while the belt 58 where it leaves the last pulley 68 of the common path is guided by means of a small pulley towards the deflection pulley 72 of the table 32. The distance between the last pulley 68 on the common path and the pulley 68*b* is less than the minimum length of a letter 20, and the orientation of the belt 56 between these two pulleys is such that each letter is brought to the support 10 at an orientation which is slightly inclined relative to the orientation which it will occupy when in the stack 18.

FIG. 2 shows two cog belts 74 on the wall 12 of the support 10 and serving to move the stack of letters towards the unstacking means 16.

The apparatus operates as follows:

The letters 20 are conveyed by the means 24 from its inlet 60 to its outlet 62, and while they are being conveyed they are pinched between the belts 56 and 58 where they run along their common path as shown in FIG. 2, with conveyor throughput being about 10 letters per second on average, for example. Each letter 20 leaving the conveyor means 24 is projected in the direction indicated by the arrow in FIG. 2 towards the stacking means 22, and more precisely between said stacking means and the last letter on the stack 18. The letter 20 leaving the conveyor means 24 is at a slight oblique angle relative to the disposition of the letters in the stack, and as a result its leading edge slides along the last letter until it comes into contact with the belt 34 passing over the pulleys 36 and 38. The arrival of the letter in this position is detected by appropriate means, e.g. by a photoelectric cell 84, which causes the drive motor means of the pulley 38 to be switched on. Rotation of this pulley gives rise, via the belt 34, to rotation of the pulley 36, and consequently to displacement of the belt 34 along the last letter in the stack towards the jogging wall 14. The letter leaving the conveyor means 24 and having its leading edge engaged between the pulley 36 and the last letter of the stack is thus moved towards the jogging wall 14 until said leading edge of the letter comes into abutment therewith. A timing circuit 86 serves to stop displacement of the belt 34 automatically. Above-mentioned plate 50 guides the letter 20 and prevents its leading edge from folding rearwards between the jogging wall 14 and the table 32.

The passage of the last stacked letter in front of the pulley 36 necessarily gives rise to the arm 40 pivoting about the axis of the pulley 38, with the rearwards displacement of the pulley 36 corresponding substantially to the thickness of the letter being stacked. The motion of the arm 40 or of the pulley 36 is detected by the means 48 whose output signal is transmitted to a servo-control circuit controlling displacement of the table 32 away from the unstacking means 16. In other words, each time a letter takes its place on the stack 18, the table 32 and the stacking means 22 move back through a distance equal to the thickness of said letter. Between two letter arrivals, the spring 46 maintains the pulley 36 in the belt 34 pressed against the last letter in the stack.

Thus, if the stack advances either regularly or jerkily towards the unstacking means 16, the motion of the arm 40 as biased by the spring 46 is detected by the means 48 and the servo-control circuit causes the table 32 to move towards the unstacking means 16.

The apparatus thus serves to form a stack of variable length on the support 10, with the stack being built up from an end of this support which is defined by the face of the unstacking means 16 at which the stack 18 begins, with the maximum length of said stack corresponding, for example, to 1,000 letters, or else having some predetermined value, e.g. about 1 meter or even more. Once this maximum stack length has been reached, e.g. due to the unstacking means 16 being stopped, the conveyor means 24 are stopped and the machine upstream therefrom may also be stopped.

In order to facilitate stacking, the means 22 may be received in a housing 88 provided with suction means 90 such as a fan and including a suction slot level with the belt 34. This ensures that each letter 26 arriving between the stacking means 22 and the last letter in the stack is pressed against the belt 34 by the suction effect, thereby making displacement of said letter until it comes into abutment with the jogging edge more reliable, without increasing the pressure applied to the preexisting stack.

The means shown in FIGS. 5 to 8 may also be used at the outlet from the conveyor means 24. The means 76 is substantially C-shaped with the belt 56 passing between the two horizontal arms of the C shape at the exit from the conveyor means 24, with the C-shape being mounted in a fixed position and being relatively rigid.

Figure 7:
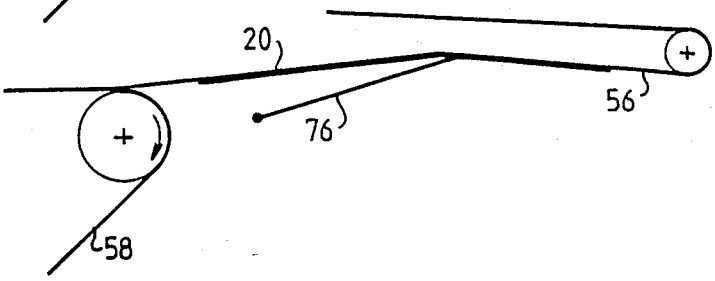
FIG. 7 is a highly schematic, plan view showing a flat object such as a letter discharged from between the conveyor belts and having its leading edge pivoted when the belt is deflected.
Figure 8:
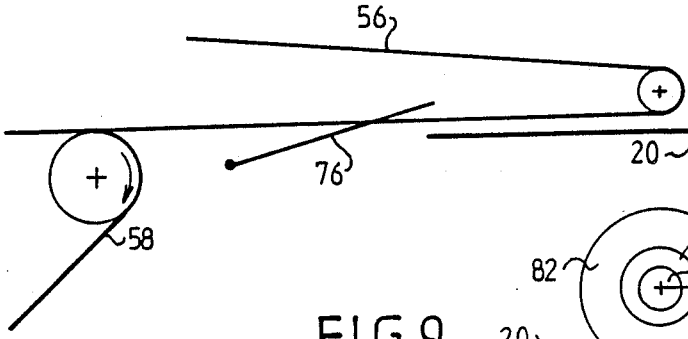
FIG. 8 is a highly schematic, plan view showing the belt deflected back to its original position and a flat object such as a letter pivoted about its leading edge.

The heights of the belts 56 and of the means 76 are less than the minimum height of a letter to be conveyed, such that each letter 20 leaving the last pulley 68 of the conveyor means 24 and passing over the arms of the C-shape 76 causes the belt 56 to be deflected inwardly, as shown in FIG. 7.

When the trailing edge of the letter 20 goes past the arms of the means 76, then the belt 56 re-engages between said branches, thereby thrusting against the trailing edge of the letter 20 (FIG. 8) and causing the letter to pivot slightly about its leading edge. This prevents the leading edge of the next letter coming into abutment against the trailing edge of the current letter.

Figure 9:
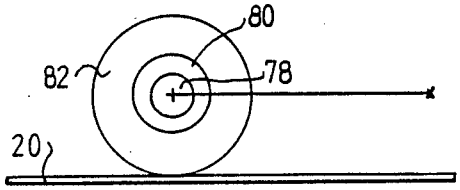
FIG. 9 is a diagram of a variant embodiment of the stacking means.

FIG. 9 shows a variant implementation of the stacking head. In this variant, the pulley 36 is replaced by a drive shaft 78 surrounded by a sleeve 80 which is constrained to rotate with the shaft 78 and which rotates inside a second sleeve 82, and which is in contact therewith. These two sleeves are made of materials such that the coefficient of friction of the sleeve 80 inside the sleeve 82 is much less than the coefficient of friction of the sleeve 82 against a letter 20 being moved by the conveyor means. Thus, when the letter 20 leaving the conveyor means 24 engages between the sleeve 82 and the last letter of the stack, the rotation of the shaft 78 and of the sleeve 80 causes the outer sleeve 82 to rotate, thereby displacing the letter 20 until its leading edge comes into abutment with the jogging wall. Thereafter, the friction of the sleeve 82 on the letter 20 causes the sleeve 82 to stop while the sleeve 80 inside it continues to rotate under drive from the shaft 78.

The drive shaft 78 may therefore be driven continuously and there is no longer any need to use a photoelectric cell and a timing circuit to control rotation thereof.

In general, apparatus of the invention is suitable for operating with conveyor means for conveying letters or flat objects of various different formats one after the other, with the objects either being separated from one another or else overlapping like roofing tiles. At the exit from the apparatus, the unstacking means serve to remove the flat objects one after another, with said objects either being separate from one another or else being in an overlapping configuration, and depending on the type of unstacking means.

Although the unstacking means in the above description are fixed in position relative to the support 10, it is clear that said means could be moveable in translation in both directions parallel to the stack forming direction, and this variant lies within the scope of the invention.

What is claimed:

1. Apparatus for forming a stack of flat objects such as letters on a support in the form of a trough having two mutually perpendicular walls with each flat object bearing thereagainst via its leading edge and via one of its side edges with one of said walls also being a jogging wall, said apparatus including conveyor means for bringing flat objects one after another to the support at a predetermined orientation, close to the orientation the flat objects are to occupy in the stack; stacking means for stacking the flat objects on the support by sliding each flat object over the preceding flat object on the stack and moving it into abutment against a jogging wall of the support; and relative displacement means for obtaining displacement of the conveyor means and the stacking means relative to the stack and the support, the stacking means being loosely mounted relative to the stack; wherein the stacking means extends between the conveyor means and jogging wall, and includes an end close to said second jogging wall, said second end having an axis about which said stacking means can pivot so that said stacking means is displaceable towards and away from the end of the stack, and return means cooperating with said stacking means for urging the stacking means continually towards the stack.

2. Apparatus according to claim 1, wherein the stacking means comprise an endless belt passing over two pulleys one of which is driven by drive means and the other of which is displaceable by pivoting about the axis of the first-mentioned pulley.

3. Apparatus according to claim 2, wherein the portion of the belt in contact with the end of the stack is parallel to the flat objects in the stack.

4. Apparatus according to claim 1, wherein the means for obtaining relative displacement of the conveyor means and the stacking means relative to the stack and to the support are controlled by means for detecting the angular position of the stacking means.

5. Apparatus according to claim 2, wherein the drive means for rotating the pulley are controlled by means for detecting the arrival of a letter, in association with timing means for automatically starting and stopping said drive means.

6. Apparatus according to claim 1, wherein the stacking means include a drive shaft carrying a first cylindrical sleeve mounted to rotate inside a second cylindrical sleeve and in contact therewith, with the coefficient of friction between the first sleeve and the second sleeve being very much less than the coefficient of friction between the second sleeve and any one of the above-mentioned flat objects.

7. Apparatus according to claim 1, wherein the stacking means and a portion of the conveyor means are mounted on a common table which is moveable in translation parallel to the direction in which the stack is built up on the support, with the other portion of the conveyor means being mounted on a fixed frame.

8. Apparatus according to claim 7, wherein the conveyor means comprise two endless belts passing over pulleys, with the flat objects being pinched between said endless belts which run parallel to each other and which press against each other over a portion of their lengths, and wherein the pulleys of the conveyor means mounted on the moving table of the stacking means are disposed in such a manner relative to the fixed frame that displacement of the moving table does not alter the length or the tension of the endless belts.

9. Apparatus according to claim 1, wherein the stacking means include a guide plate for guiding the flat objects and extending from the outlet of the conveyor means to the jogging wall of the support, with the corresponding leading edge of the guide plate including projections or teeth engaged in grooves in the jogging wall, said grooves running parallel to the direction in which the stack is formed.

10. Apparatus according to claim 1, wherein the stacking means are received in a housing containing air suction means for putting the inside of the housing at a reduced pressure such that each flat object is sucked onto the drive means.

11. Apparatus according to claim 1, including means mounted in fixed position to said conveyor means, said means being of substantially C-shaped configuration and having two arms through which said conveyor means passes so as to cause deflection of said conveyor means at the position adjacent said C-shaped means when a flat object is conveyed therealong so as to pivot a conveyed flat object along a leading edge thereof.

* * * * *